US006705756B2

(12) United States Patent
Botrie et al.

(10) Patent No.: US 6,705,756 B2
(45) Date of Patent: Mar. 16, 2004

(54) APPARATUS AND METHOD FOR MIXING AND DISPENSING COMPONENTS OF A COMPOSITION

(75) Inventors: Alex Botrie, Toronto (CA); Tuan Nguyen, Brampton (CA)

(73) Assignee: Chemque, Incorporated, Ontario (CA)

( * ) Notice: Subject to any disclaimer, the term of this patent is extended or adjusted under 35 U.S.C. 154(b) by 35 days.

(21) Appl. No.: 10/094,963

(22) Filed: Mar. 12, 2002

(65) Prior Publication Data

US 2003/0174577 A1 Sep. 18, 2003

(51) Int. Cl.[7] ..... B01F 3/10; B01F 5/00; B01F 15/02; B67D 5/18

(52) U.S. Cl. ..... 366/181.5; 366/336; 366/340; 222/145.6; 222/136; 222/325

(58) Field of Search ..... 366/181.5, 336, 366/338, 339, 340; 222/135, 136, 137, 145.5, 145.6, 327, 326, 325

(56) References Cited

U.S. PATENT DOCUMENTS

| | | | | |
|---|---|---|---|---|
| 2,085,132 A | * | 6/1937 | Underwood | 366/340 |
| 3,159,312 A | * | 12/1964 | Van Sciver, II | 222/145.6 |
| 3,185,447 A | * | 5/1965 | Hach | 366/336 |
| 3,286,992 A | | 11/1966 | Armeniades et al. | |
| 3,323,682 A | | 6/1967 | Creighton, Jr. et al. | |
| 3,623,704 A | * | 11/1971 | Skobel | 366/337 |
| 3,701,619 A | * | 10/1972 | Appledoorn et al. | 366/336 |
| 3,799,509 A | * | 3/1974 | Bydal | 366/338 |
| 4,643,336 A | * | 2/1987 | Mandeville et al. | 222/145.6 |
| 4,676,657 A | | 6/1987 | Botrie | 222/136 |
| 4,969,747 A | * | 11/1990 | Colin et al. | 222/145.6 |
| 5,350,233 A | * | 9/1994 | Sonntag et al. | 366/339 |
| 5,386,928 A | | 2/1995 | Blette | |
| 5,433,084 A | * | 7/1995 | Kaiser et al. | 366/339 |
| 5,542,578 A | * | 8/1996 | Buckles | 222/145.6 |
| 5,909,959 A | * | 6/1999 | Gerich | 366/339 |
| 6,079,868 A | * | 6/2000 | Rydell | 222/145.6 |

FOREIGN PATENT DOCUMENTS

| | | | |
|---|---|---|---|
| DE | 34 00 280 | * | 3/1985 |
| DE | 36 09 556 | * | 3/1986 |
| DE | 3632242 | | 4/1988 |
| EP | 0150 716 | | 8/1985 |

* cited by examiner

*Primary Examiner*—Tony G. Soohoo
(74) *Attorney, Agent, or Firm*—Banner & Witcoff, Ltd.

(57) ABSTRACT

A cartridge assembly used with a conventional caulking gun for mixing and dispensing components of a material. The cartridge assembly includes a component carrying body that has a plurality of separate component reservoirs and a component flow directing housing at a forward end of the reservoirs. A mixing unit extends between the component flow directing housing and a discharge nozzle secured to the front end of the carrying body. The mixing unit mixes the components and delivers them to the discharge nozzle. The mixing unit includes a plurality of mixing cylinders that each have a longitudinal axis that extends substantially parallel to the longitudinal axis of the component carrying body. The mixing cylinders and guiding channels that extend between them form at least a portion of a component mixing path. The mixing cylinders can each include one or more mixing elements.

60 Claims, 11 Drawing Sheets

APPARATUS AND METHOD FOR MIXING AND DISPENSING COMPONENTS OF A COMPOSITION

FIELD OF THE INVENTION

This present invention relates to an apparatus and method for dispensing materials formed from components that should not be mixed until immediately prior to use. More specifically, the invention relates to a device and method for mixing a first component with a second component that causes a chemical reaction to take place.

BACKGROUND OF THE INVENTION

A variety of materials are made of two or more initially separate components that are preferably not mixed until immediately prior to use. Examples of such materials include two reactive component polymers such as epoxies, polyurethanes, polyesters and silicones. In many instances, such two-component materials may unduly cure, harden or become otherwise unsatisfactory for use if mixed too far in advance of the actual time that the material is applied to the work site. As a result, the components are housed in separate, isolated containers.

The isolated containers for each component can be housed in standard sized, elongated disposable cartridges that are received in caulking guns or similar devices such as those disclosed in U.S. Pat. No. 3,323,682 to Creighton, Jr. et al. and U.S. Pat. No. 4,676,657 to Botrie. These cartridges can comprise a tubular cylindrical outer body with top and bottom ends. The top end contains an integral or detachable dispensing nozzle, while the bottom end permits access to a movable plunger that retains the materials within the body and provides a surface for the caulking gun to act against when applying dispensing pressure to the contents of the cartridge. The housing includes at least two internal reservoirs. Each of these reservoirs houses one of the components to be mixed and dispensed. In order to dispense the contained components, the disposable cartridge is securely positioned in the caulking gun or similar device as is known in the art. The action of the caulking gun on the plunger at the rear end of the cartridge causes the contained components to be mixed and the composition dispensed.

U.S. Pat. No. 4,676,657 to Botrie, which is hereby incorporated by reference, further discloses a mixing unit is located within the cartridge for mixing the two components as they are forced toward the dispensing nozzle by the plunger. The mixing unit has an inlet port through which the components enter the mixing unit and an outlet port by which the mixed components exit the mixing unit. The mixing unit also includes a mixing body formed of three identical discs. The discs include complementary opposite handed grooves formed on both sides and connected at their outer ends by a port. When the discs are secured together, they define a double spiral passage extending outwardly from the inlet port, through the ports between the discs and ending at the outlet port. Trapped within the spiral passage are passive mixing elements that combine the components. After being mixed along the circular mixing path of the double spiral passage, the composition exits the mixing unit through the outlet port and is delivered to the nozzle for dispensing. While the circular mixing path is acceptable for mixing some components, it may not evenly mix all components no matter their viscosity.

U.S. Pat. No. 5,386,928 to Blette discloses a system for dispensing compositions made from two components. The system includes a side-by-side pair of collapsible reservoirs that fit within a barrel of a pressurized air applicator. As air is admitted into the barrel, the tubes simultaneously collapse to direct components in the tubes through outlet ports and into a static mixer where the components are mixed to a homogeneous composition. The static mixer includes passive mixing elements positioned within the dispensing nozzle. Each tube includes a relatively rigid top and bottom end piece, and the end pieces are coupled together by pin elements for ease of handling and to facilitate dispensing of the contained components. The length of the mixing path in the dispensing nozzle and the number of passive mixing elements positioned within the mixing path are not sufficient to thoroughly mix the components for some applications, especially when the components have different viscosities. While additional static mixers could be placed in the dispensing nozzle to improve the mixing, the result is a very long and cumbersome nozzle that is awkward to place into position and to handle.

BRIEF SUMMARY OF THE INVENTION

The present invention provides a disposable cartridge for a two component systems that can be manufactured economically, that can maintain accurate proportions of the components during use and that can provide efficient mixing of the components prior to dispensing. The present invention also includes a mixing unit that provides accurate and complete mixing of the components.

One embodiment of the invention includes a cartridge assembly for mixing components of a material. The cartridge assembly comprises a component carrying body with a longitudinal axis that extends between a front end and a rear end of the carrying body. The cartridge assembly also comprises a discharge nozzle that is proximate the front end of the carrying body and a mixing unit for mixing the components and delivering the mixed components to the discharge nozzle. The mixing unit includes a plurality of mixing cylinders that each have a longitudinal axis that extends substantially parallel to the longitudinal axis of the component carrying body.

Another aspect of the invention includes a cartridge assembly for mixing components of a material. The cartridge assembly comprises a component carrying body having a front end and a rear end. A discharge nozzle is positioned proximate the front end for dispensing the mixed components. The cartridge assembly also includes a mixing unit for mixing the components and delivering the mixed components to the discharge nozzle. The mixing unit comprises a plurality of spaced cylindrical mixing chambers and at least one mixing element positioned in at least one of the mixing chambers.

Another aspect of the invention includes a cartridge assembly for use with a caulking gun to mix and dispense components of a material. The cartridge assembly comprises a component carrying body having a front end, a rear end and a mixing unit for mixing the components and delivering the mixed components to a discharge nozzle. The mixing unit comprises a mixing body including a mixing path that extends between a front end and a rear end of the mixing body. The mixing path has a first mixing region that is offset from a terminal mixing region in a direction that is opposite the direction of the mixing path. This change in direction provides improved mixing with fewer static mixers than would be required if the mixers were arranged in a straight, linear pattern. This new design can also hold more length of static mixers than the conventional mixer design described, for example, in U.S. Pat. No. 4,676,657 to Botrie.

A further aspect of the present invention includes a cartridge assembly for use with a caulking gun to mix and dispense components of a material. The cartridge assembly comprises a component carrying body having a front end, a rear end and a mixing unit for mixing the components and delivering the mixed components to a discharge nozzle. The mixing unit comprises a mixing body including a mixing path that extends between a rear end and a front end of the mixing body for moving the components from the rear end of the mixing body to the front end of the mixing body and then back to the rear end of the mixing body.

A still further aspect of the present invention includes a cartridge assembly for mixing and dispensing components of a material. The cartridge assembly comprises a component carrying body having a front end, a rear end and a mixing unit for mixing the components and delivering the mixed components to a discharge nozzle. The mixing unit comprises a mixing body including a substantially sinusoidal shaped mixing path.

Further features of the invention will become apparent from the following description of preferred embodiments thereof with reference to the accompanying drawings.

DETAILED DESCRIPTION OF THE INVENTION

Figure 1:
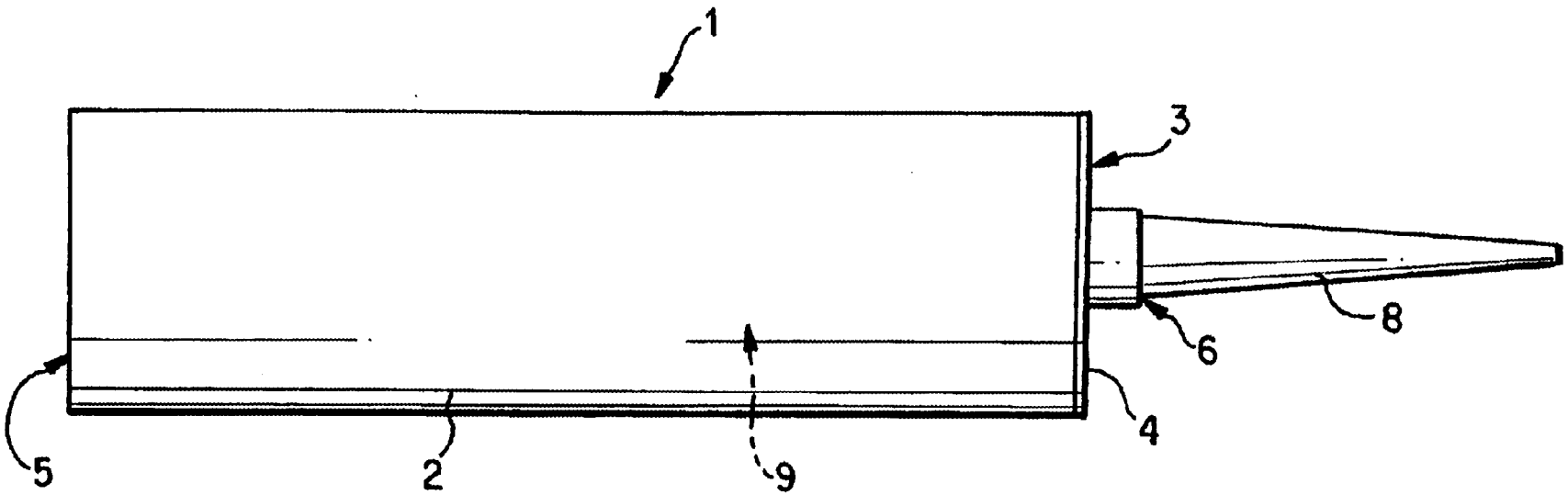
FIG. 1 is a side elevational view of a cartridge assembly according to the present invention.

As illustrated in FIG. 1, the present invention includes a two component meter mix dispenser that includes a disposable cartridge assembly 1 for holding components A, B that can be mixed together to form a material, such as a resin. The cartridge assembly 1 is sized and configured for use with a conventional caulking gun (not shown) or other known dispensing devices. The disposable cartridge assembly 1 includes a conventional, elongated rigid tubular cylindrical mixer body 2 with a front end 3, a rear end 5 and a component containing interior 9.

Figure 2:
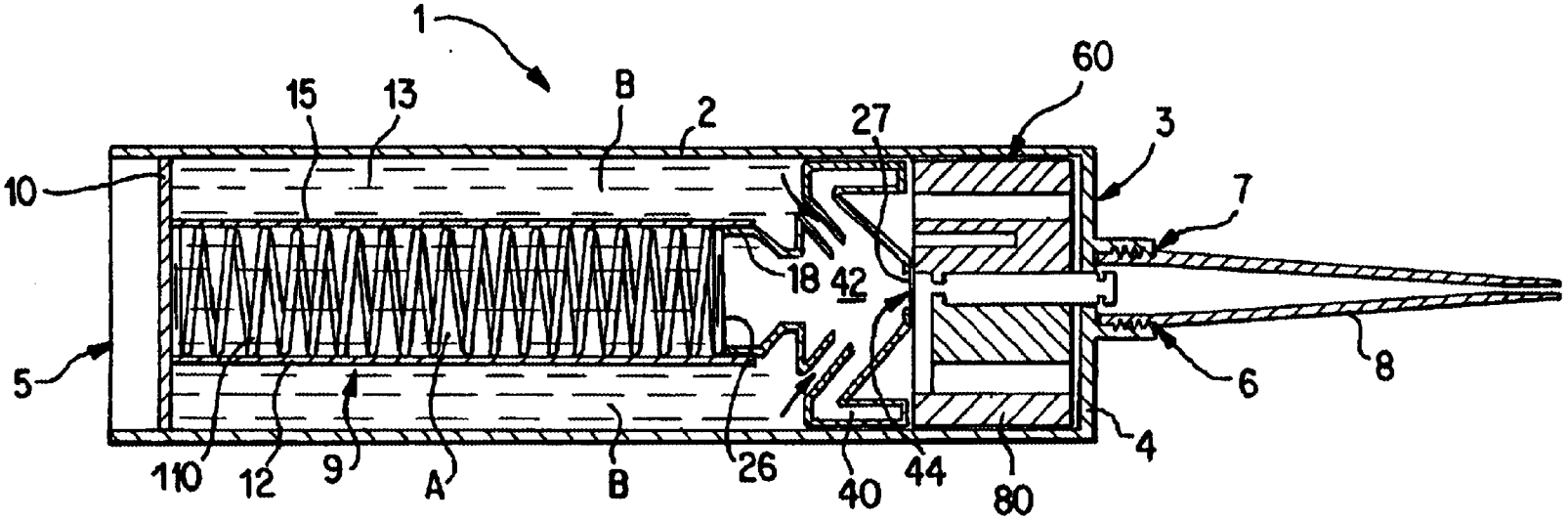
FIG. 2. is a longitudinal cross section through a cartridge assembly according to the present invention.

As illustrated in FIG. 2, the front end 3 includes an end plate 4 with a centrally located discharge opening 6. The end plate 4 also includes a fastening system 7 for securely receiving and retaining a discharge nozzle 8. The fastening system 7 can include threads for mating with corresponding threads on the discharge nozzle 8. In an alternative embodiment, the fastening system 7 could include a known friction or snap fit system for securing the discharge nozzle about the discharge opening 6.

The cylindrical body 2, end plate 4 and discharge nozzle 8 can be formed by any manner of conventional construction. For example, the cylindrical body 2 can be formed of metal, cardboard or plastic, while the end plate 4 and discharge nozzle 8 can be metal or plastic. If the end plate 4 is formed of a plastic, it can be integrally molded with the body 2 as a single, continuous unit. Additionally, the end plate 4 and discharge nozzle 8 can be integrally molded together as a single unit, no matter if the end plate 4 is molded together with the cylindrical body 2. In an additional embodiment, the end plate 4 can be removably secured to the body 2 in a known manner, such as by cooperating threaded surfaces.

As shown in FIG. 2, the rear end 5 of the cartridge 1 includes a conventional cup shaped plunger 10 that has an outer circumference that frictionally engages the inner walls of the body 2. The plunger 10 prevents the components A, B within the body 2 from escaping as is well known in the art. The plunger 10 can be formed of any suitable material used in the art such as plastics or metal. During the operation of the present invention, the plunger 10 is moved from the rear end 5 toward the front end 3 by the advancing action of a push rod of a caulking gun in order to expel the components A, B from the body 2 as is known.

The body 2 also includes a collapsible container 12 for holding a first of the two components A. An outer surface of the collapsible container 12 and an inner surface of the body 2 define a reservoir 13 for holding a second of the two components B. As can be understood, the walls of the container 12 and the plunger 10 keep the two components separated and isolated from each other.

Figure 3:
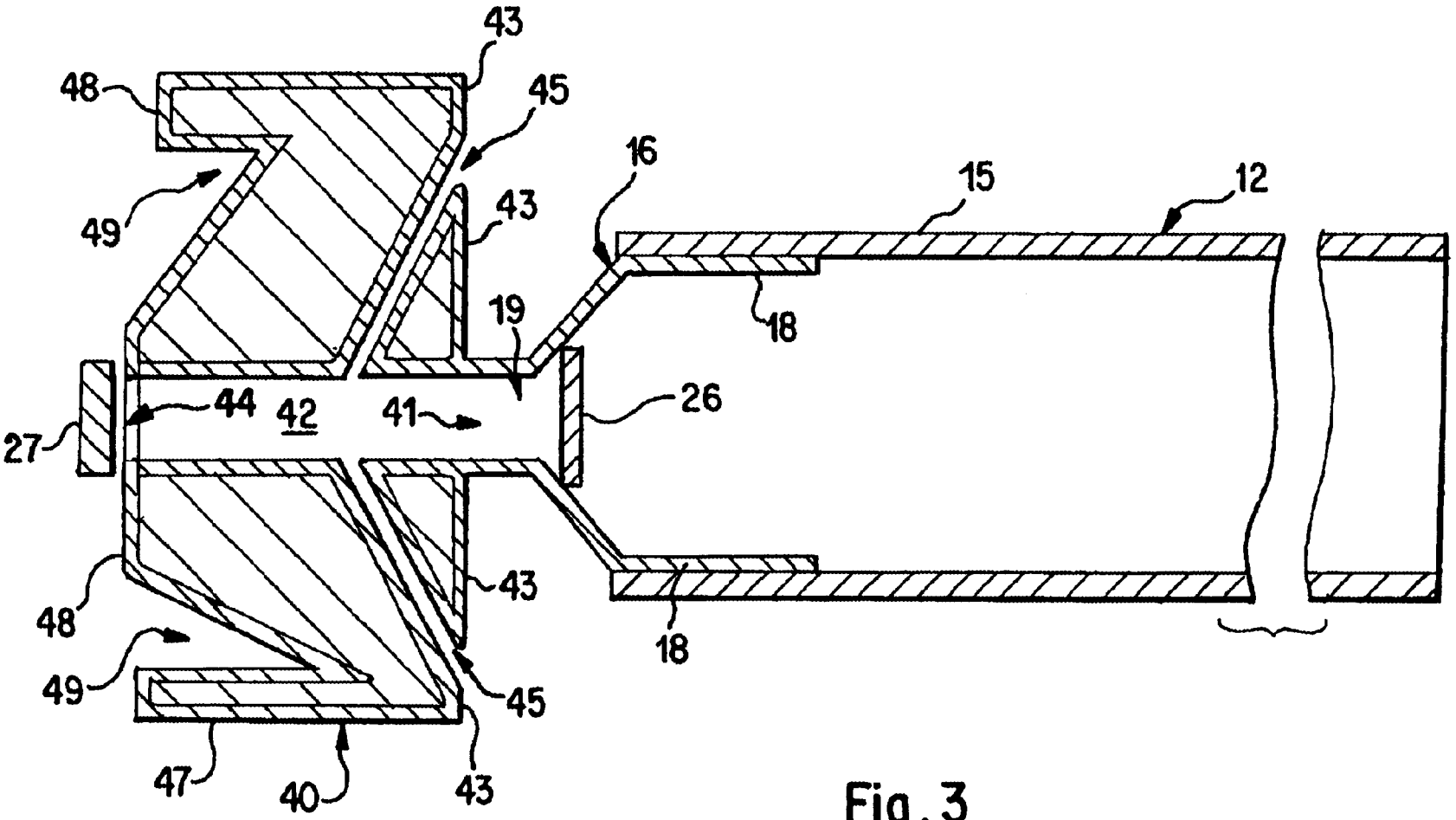
FIG. 3 is an enlarged cross section taken along the line 3—3 shown in FIG. 7 through a locating and transporting member and a flow directing member shown in FIGS. 2 and 7.
Figure 6:
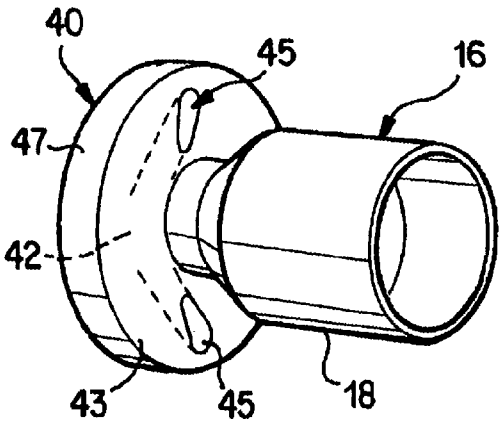
FIG. 6 is a perspective view of the locating and transporting member and the flow directing member shown in FIGS. 2 and 7.

The container 12 is formed by a cylindrical tube 15 made of a thin flexible film, such as a synthetic plastic film that is resistant to both components A, B of the mixture contained within the body 2. The tube 15 is closed at both ends for securely holding the contained component A. As shown in FIG. 3, a front end of the tube 15 is bonded by an adhesive or radiant energy (light, heat, etc.) to a locating and transporting member 16 that slides within the body 2. The locating and transporting member 16 has a collar 18 around which the front end of the tube 15 is secured. In an alternative embodiment, the collar 18 is secured around the outside of the front end of the tube 15.

Figure 4:
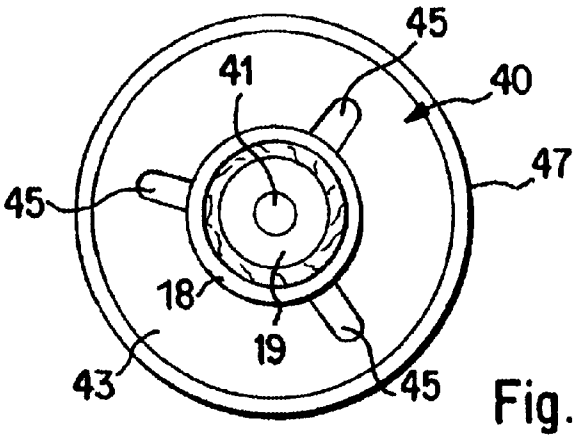
FIG. 4 is a rear elevational view of the locating and transporting member and the flow directing member shown in FIGS. 2 and 7.

As shown in FIG. 3, the front end of the collar 18 tapers toward and is secured to a rear potion of a flow directing member 40 which slides within the body 2 with collar 18. Collar 18 can be integrally formed with flow directing member 40 as a single unit or they can be formed as separate units and secured together to form a single unit. The front end of the collar 18 has a centrally located opening 19 that communicates with a rear opening 41 of the flow directing member 40 to deliver component A from the tube 15 to a receiving well 42 in the flow directing member 40 as shown in FIG. 3. The flow directing member 40 also includes a plurality of channels 45 that extend from its rear, component contacting surface 43 to the receiving well 42. While three channels 45 are illustrated in FIG. 4, any number of channels 45 can be used. For example, the flow directing member 40 could include one to six channels 45. As shown in FIGS. 3 and 4, the rear openings of the channels 45 are substantially elliptical or substantially circular in shape and open to the reservoir 13 so that the well 42 is in communication with the reservoir 13 for delivering the component B within the reservoir 13 to the well 42. The larger the opening of channel 45, the larger the amount of component B delivered to the well 42 at one time. By controlling the diameter and number of these channels 45 the flow rate of component B can be tightly controlled. In one embodiment, the flow rate of component B can be controlled to be the same as the flow rate of component A. In alternative embodiments, the flow rate of one component can be a fraction of the flow rate of the other component so that more of one component is received. The diameter of these channels 45 is an effective way to control the flow rate of the components A and B when they have very different viscosities. The actual diameter, number of channels 45 and flow rates will depend on the components being mixed. It is contemplated that the channels 45 could include rupturable seals.

When the plunger 10 is forced toward the front of the cartridge 1, the component A in tube 15 is forced into the well 42 through collar 18 and opening 41, while the component B in reservoir 13 is forced through channels 45 into well 42. A front opening 44 in the flow directing member 40 is open to the well 42 to deliver and direct the components A, B from the well 42 to a mixing unit 60 in response to the movement of the piston 10.

Figure 5:
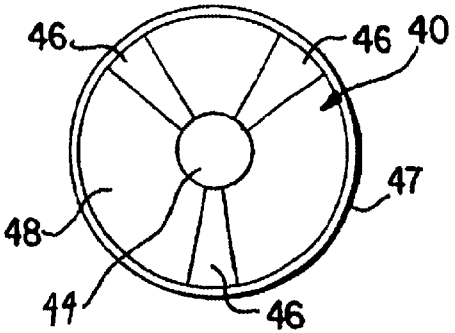
FIG. 5 is a front elevational view of the locating and transporting member and the flow directing member shown in FIGS. 2 and 7.
Figure 7:
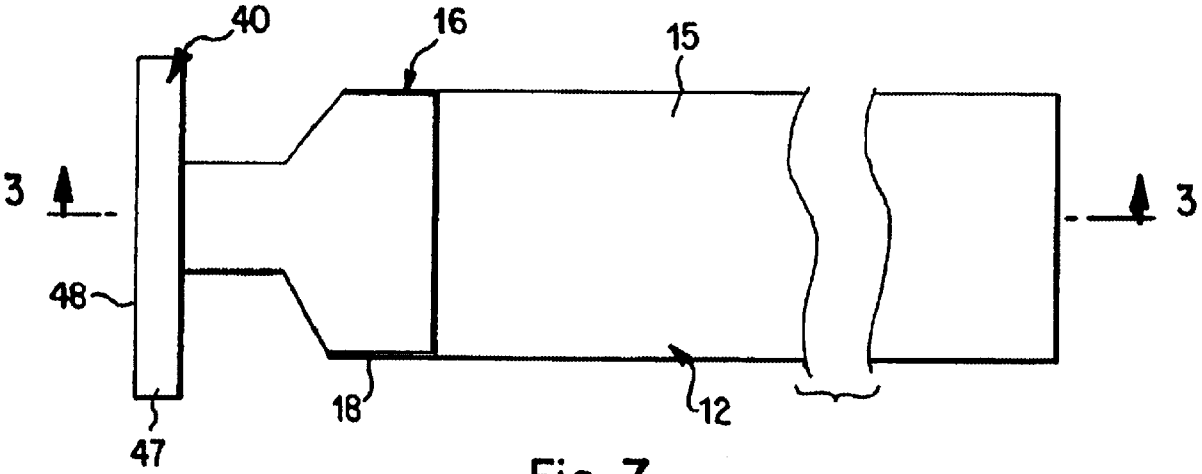
FIG. 7 is a side elevational view of the locating and transporting member and the flow directing member shown in FIGS. 2 and 7.

As illustrated in FIG. 3, the flow directing member 40 also includes a disc-shaped sidewall 47 that contacts the inner walls of body 2 to position the flow directing member 40 within the body 2 and to provide support to the well 42 to prevent longitudinal and radial collapse. A forward surface 48 of the flow directing member 40 includes ridges 46 that provide support and additional size to the channels 45 as shown in FIGS. 3 and 5. The greater the distance that the ridges 46 extend from the forward surface 48, the larger the width/diameter of the channels 45 can be made. The flow directing member 40 also includes a forward recess 49.

FIG. 3 also illustrates a rupturable seal 26 that is positioned over the opening 19 for initially sealing the rear opening 41 from the interior of the tube 15. Alternatively, the seal 26 could be positioned within the well 42 over the opening 41. A rupturable seal 27 is also positioned over the opening 44 for sealing the well 42 including the components A, B from the mixing unit 60. The rupturable seals 26, 27 are formed either by the film of the tube or by a separate membrane of, for example, aluminum foil. However, other known rupturable sealing materials can also be used.

A light gauge compression coil spring 110 (FIG. 2) can be positioned and sealed within the tube 15. The coil spring 110 has a free length that is at least equal to the distance between the plunger 10 and the discharge opening 6 at the other end of the cartridge 1. The spring 110 has a diameter substantially the same as that of the tube 15, and acts both to support the walls of the tube 15 against radial collapse, and to hold the tube against the plunger 10. In an alternative embodiment, in place of the spring 110, the tube 15 can be molded to contain ribs that allow the bag to collapse like an accordion when the plunger 10, is pushed. Tube 15 can also be constructed in a manner where rigid walls collapse when plunger 10 is pushed.

Figure 8:
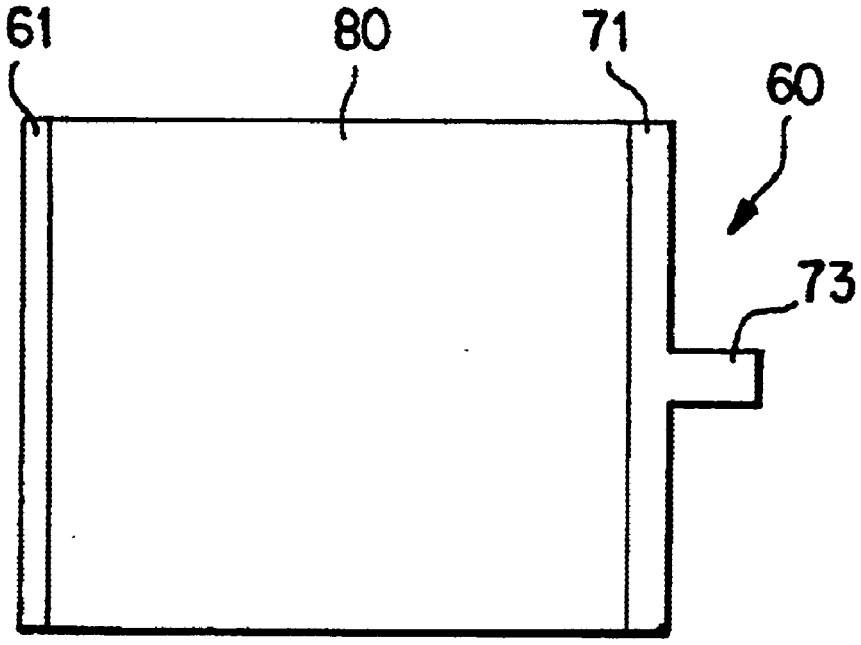
FIG. 8 is a side elevational view of a mixing unit according to the present invention and shown in FIG. 2.

The mixing unit 60, shown in FIGS. 2 and 8–13, is also provided within the body 2 for mixing the components A, B delivered from the flow directing member 40 through opening 44. The mixing unit 60 includes a rear plate 61, a front plate 71 and a mixing body 80 positioned between the plates 61, 71 (FIG. 8). In a preferred embodiment, the mixing unit 60 is about 1.75 inches long (length being measured in a direction parallel to longitudinal axis of the cartridge assembly 1). The length of the mixing unit 60 is not dependent on the number of mixing elements 140.

As shown in 11A–11D, the rear plate 61, front plate 71 and mixing body 80 define a substantially sinusoidal shaped mixing path that extends around the mixing unit 60 as discussed below. The rear plate 61 includes a central, inlet opening 62 that is aligned with and in communication with the front opening 44 of the flow directing member 40 so that the unmixed components A, B are delivered from the well 42 to the mixing body 80 after being united in the flow directing member 40. The rear plate 61 also includes a rear surface 63 that forms the rear outer surface of the mixing unit 60, and an inner surface 64 that faces the mixing body 80.

Figure 9A:
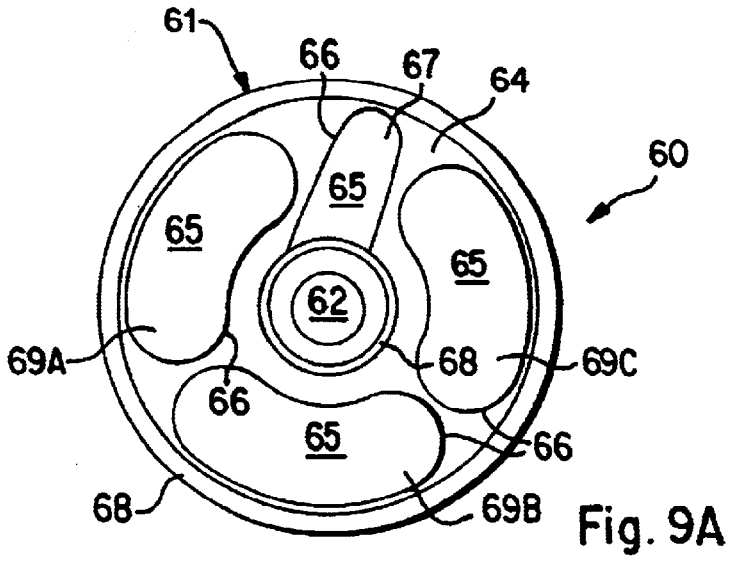
FIG. 9A is a plan view of an inner surface of a rear plate of the mixing unit.
Figure 9B:
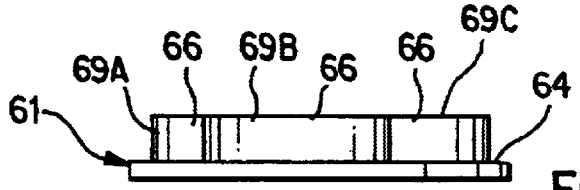
FIG. 9B is a side elevational view of the rear plate shown in FIG. 9A.

As shown in FIGS. 9A and 9B, the inner surface 64 includes a plurality of component flow guide channels 65 spaced around its circumference. Each channel 65 has at least one sidewall 66 that extends from the inner surface 64 in the direction of the mixing body 80. The sidewalls 66 of the channels 65 cooperate with the mixing body 80 as discussed below for guiding the components A, B along the mixing path within the mixing unit 60. A first channel 67 extends radially across the rear plate 61 and has a discontinuous sidewall 66 with an end that is open to the inlet opening 62 for receiving the components A, B that enter the mixing unit 60 through the inlet opening 62 as shown in FIG. 9A. The remaining channels 69A, 69B and 69C are substantially arcuate in shape and substantially coextensive with a portion of the circumference of the rear plate 61. As seen in FIG. 9A, the channels 69A–69C have at least one continuous sidewall 66 that is shaped substantially like a kidney bean and spaced from an edge of the plate 61 a distance that is equal to about the thickness of the walls of the mixing body 80. As discussed below, the shape and position of the channels 69A–69C cooperate with the mixing body 80 to form a portion of the mixing body. Also, the channels 67 and 69A–C could include any shape. FIG. 9A also illustrates grooves 68 are formed in the inner surface 64 for engaging lips on the mixing body 80 to seal the area within the plate 61 and around opening 62.

Figure 10A:
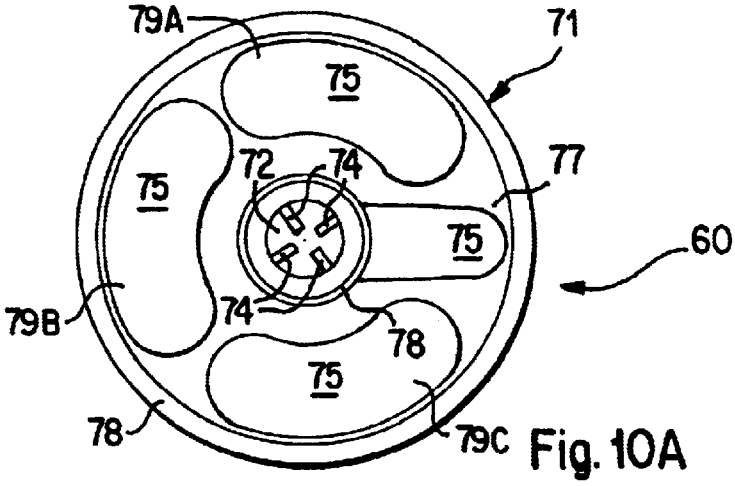
FIG. 10A is a plan view of an inner surface of a front plate of the mixing unit.
Figure 10B:
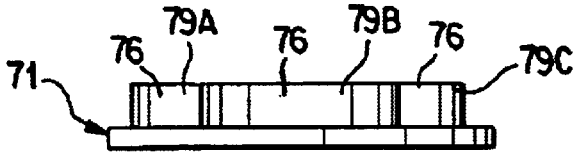
FIG. 10B is a side elevational view of the front plate shown in FIG. 10A.
Figure 14:
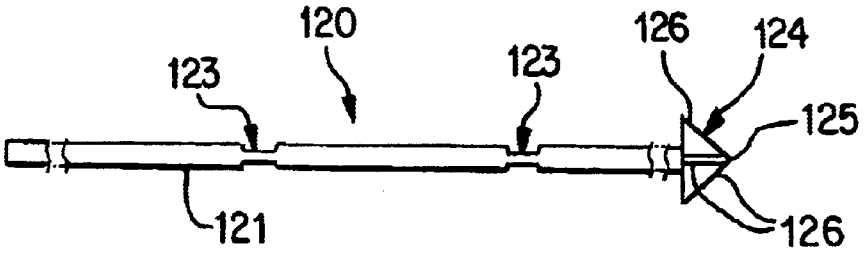
FIG. 14 is an elevational view of a piercing rod according to the present invention.

As shown in FIGS. 10A and 10B, the front plate 71 includes a central, outlet opening 72. However, unlike the inlet opening 62, outlet opening 72 has a forwardly extending extension 73 (FIG. 8) that is received within the extended discharge opening 6 and in the direction of installed discharge nozzle 8. The extension 73 includes a plurality of internal ribs 74 that extend inwardly into the opening 72, as shown, to support the piercing rod 120 (FIG. 14). While four ribs 74 are shown, any number of ribs 74 may be included. The front plate 71 also includes a plurality of component flow guide channels 75 on its inner face for guiding the components A, B along the mixing path within the mixing unit 60 as discussed above with respect to rear plate 61 and channels 65. The channels 75 are spaced around the circumference of plate 71 as illustrated in FIG. 10A. Each channel 75 has at least one sidewall 76 that extends in the direction of the mixing body 80.

Channels 79A, 79B and 79C are shaped substantially like a kidney bean and have a continuous sidewall 76 as discussed above with respect to channels 69A–C. The channels 79A–79C cooperate with the mixing body 80 to deliver the components A, B to a fourth channel 77, which then directs the mixed components A, B to the discharge nozzle 8. The channel 77 extends radially across the front plate 71 and has a discontinuous sidewall 76 with an end that is open to the outlet opening 72 for delivering the mixed components A, B to the outlet opening 72 and the discharge nozzle 8. FIG. 10A also illustrates grooves 78 are formed in the inner surface for engaging lips on the mixing body 80 to seal the area within the plate 71 and around opening 72.

Figure 11A:
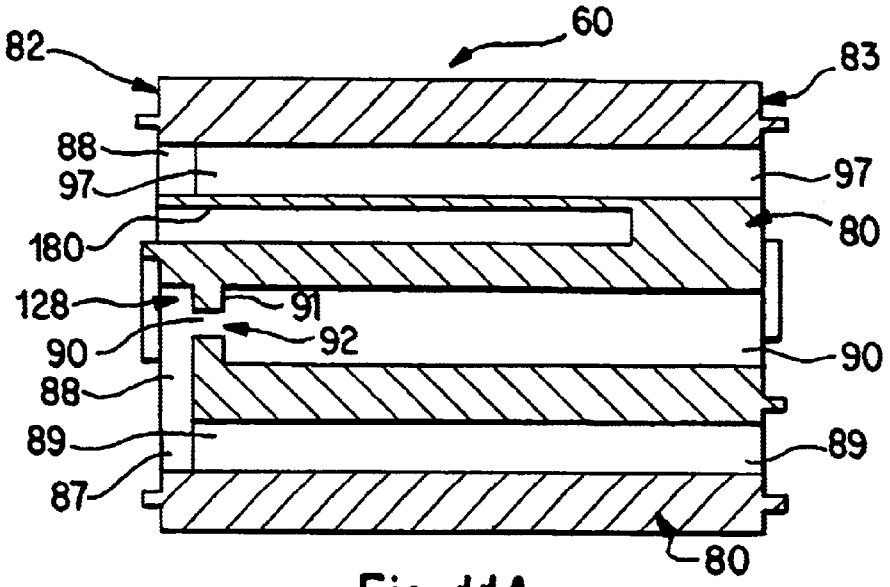
FIG. 11A is a cross sectional view of a mixing body of the mixing unit taken along the lines 11—11 of FIGS. 12 and 13.
Figure 11B:
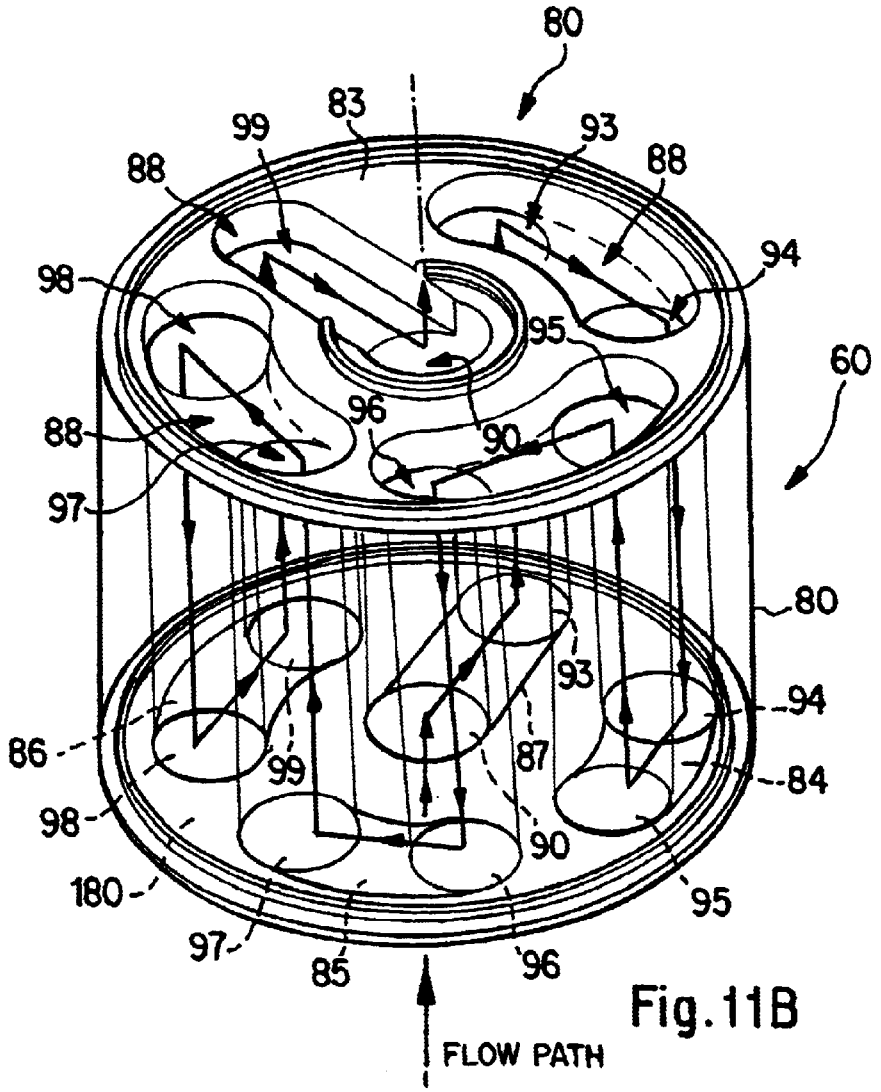
FIGS. 11B–11D illustrate a mixing path and the resulting flow of the components through the mixing body illustrated in FIG. 11A.
Figure 11D:
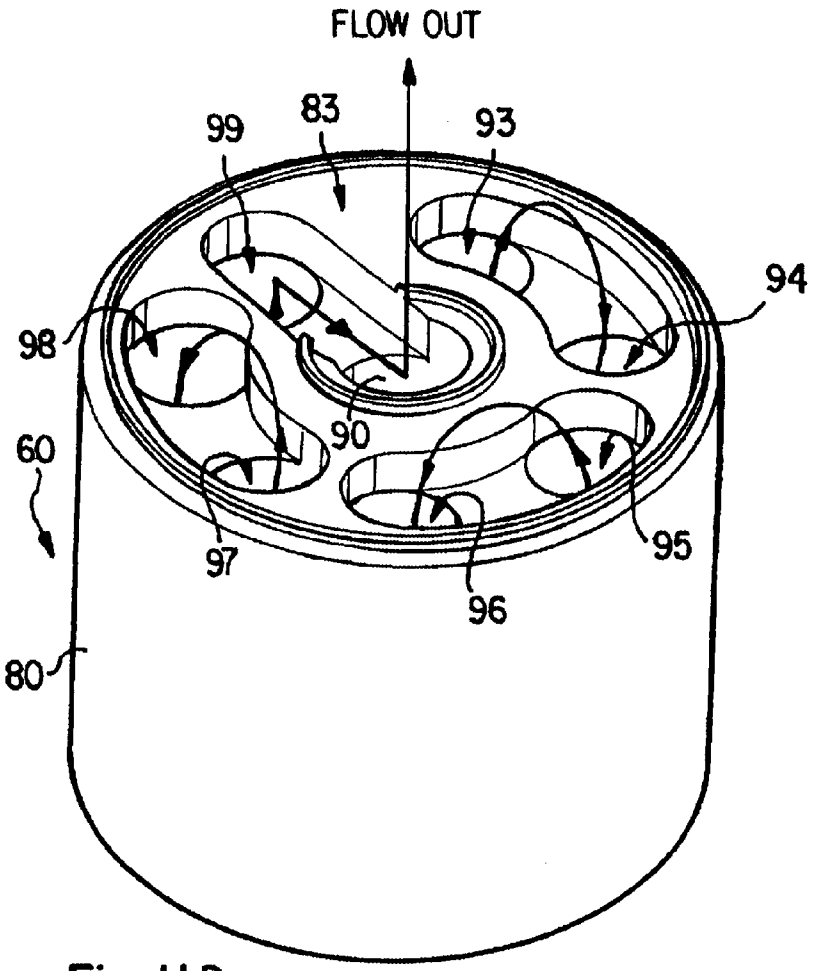
Figure 11C:
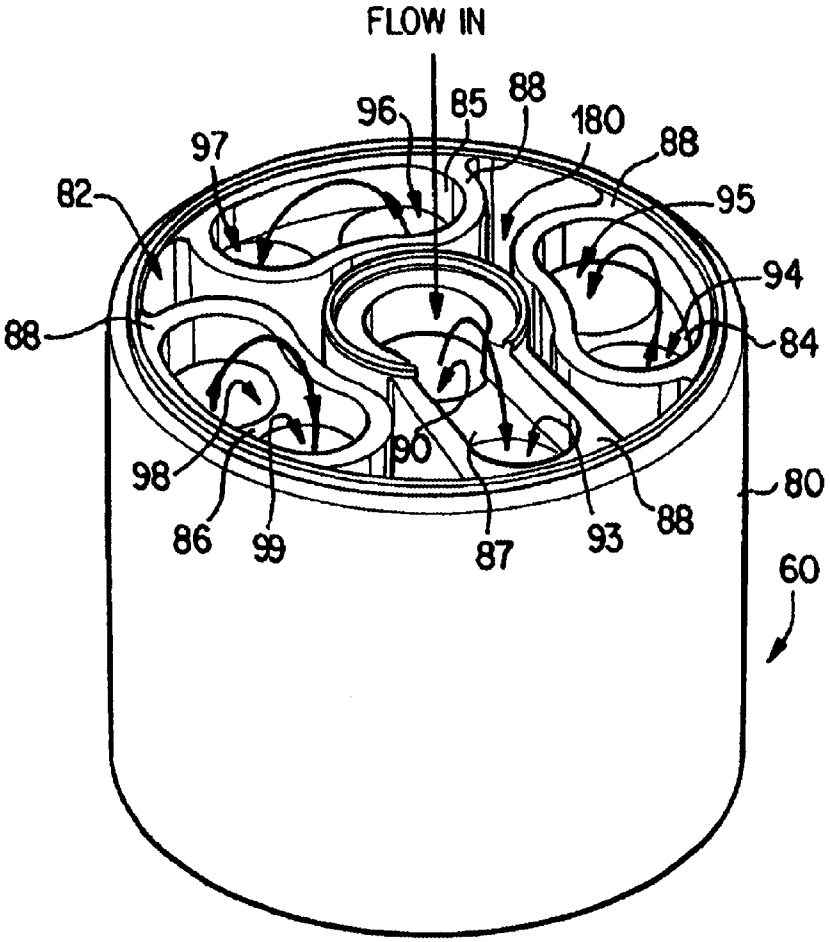
Figure 12:
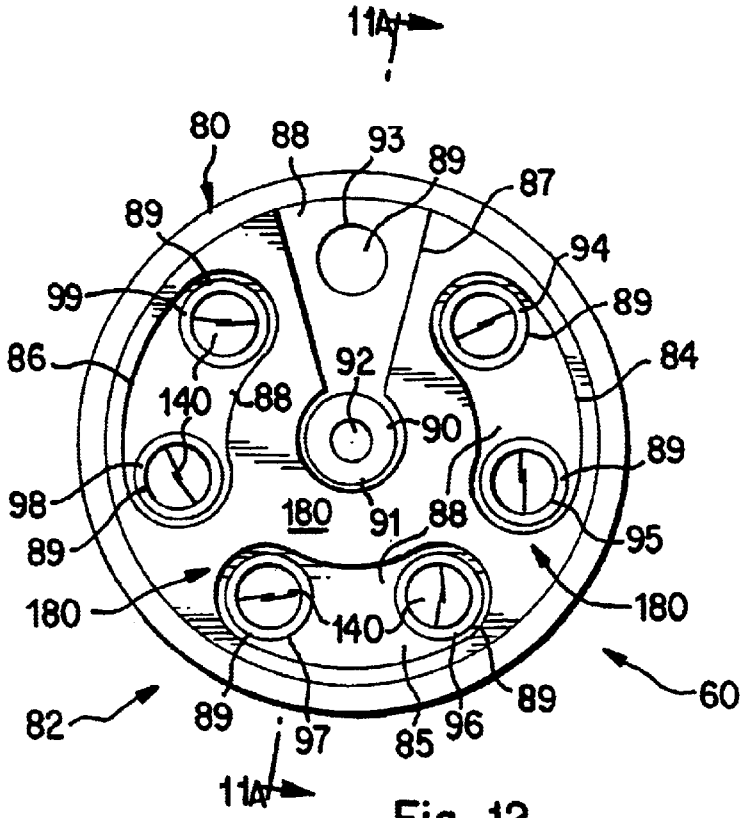
FIG. 12 is a plan view of a rear end of the mixing body shown in FIGS. 11A–11D.
Figure 13:
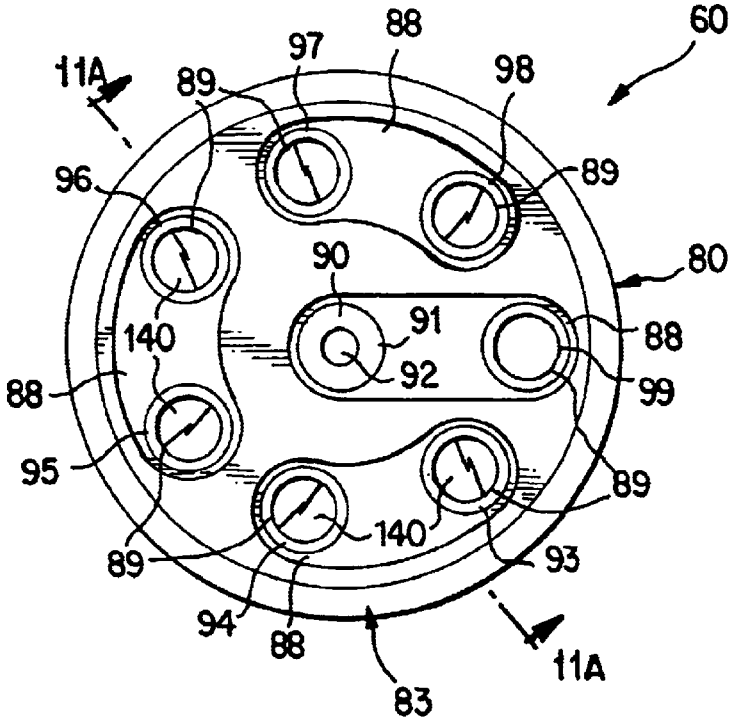
FIG. 13 is a plan view of a front end of the mixing body shown in FIGS. 11A–11D.

As shown in FIGS. 11–13, the mixing body 80 is cylindrical in shape, has a circular cross section and has a plurality of circumferentially positioned mixing housings 84–87. At the rear end 82 of the mixing body 80 and along a portion of the length of the mixing body 80, the mixing housings 84–87 are circumferentially spaced from each other by open gaps/regions 180 as shown in FIG. 12. Each housing 84–87 includes at least one mixing cylinder 89 that has a circular cross section and that extends longitudinally along the length of the mixing body 80. A flow channel 88 surrounds the ends of the mixing cylinders 89 at the rear end 82 of the mixing cylinders 89 of each housing 84–87, and thereby connects the mixing cylinders 89 of the same housing 84–87 for delivering the components A, B from one mixing cylinder 89 to the adjacent mixing cylinder 89 of the same housing 84–87. The mixing cylinders 89 of adjacent housings 84–87 are isolated at the rear end 82 by the sidewalls of their respective flow channels 88 and the gaps 180.

At the front end 83 of the mixing body 80, the mixing cylinders 89 of adjacent mixing housings 84–87 are connected and in communication with each other by a flow channel 88 so that the components A, B can flow from a mixing cylinder 89 of one mixing housing 84–87 to a mixing cylinder of an adjacent mixing housing 84–87. Unlike at the rear end 82, the mixing cylinders 89 of the same mixing housing 84–87 are isolated from each other at the front end 83 of the mixing body 80 by the wall(s) of the channels 88.

As illustrated in FIG. 12, the mixing housing 87 extends radially away from the center of the mixing body 80 toward the sidewall of the mixing body 80. One mixing cylinder 89 of the housing 87 is the center cylinder 90 of the mixing body 80. At the front end 83 of the mixing body 80, the cylinder 90 is open and in communication with mixing cylinder 99 (shown in FIG. 13) and the central aperture 72. At the rear end 82, the cylinder 90 includes a plate 91 for directing the compounds entering through aperture 62 into the first mixing cylinder 93 to begin the mixing process (FIG. 12). The plate 91 is spaced along the length of the cylinder 90 from the rear end 82 and has a centrally positioned opening 92 with a diameter sized to receive a stem 121 of piercing rod 120.

The opening 92 has a diameter that is only slightly larger (1 to 5 mm) than that of the stem 121 of the piercing rod 120 (FIG. 14) so that a friction fit can be achieved between the stem 121 and the sidewall of the opening 92 along the length of the stem 121 except at the portions of reduced cross section 123. These reduced portions 123 also permit registration of the position of a piercing head 124 of the piercing rod 120. As shown in FIG. 14, the piercing head of the piercing rod 120 can include a pointed tip 125 and a plurality of puncturing ribs 126. The positioning of the plate 91 from the rear end 82 and the diameter of the cylinder 90 and the opening 62 provide a recess 128 that is large enough to receive and contain piercing head 124 so that it will not prematurely puncture anything within the body 2.

While only four mixing housings 84–87 and two mixing cylinders 89 per mixing housing are illustrated, the mixing body 80 could include any number of mixing housings, for example between two and ten housings, and any number of mixing cylinders, such as between one and ten. As illustrated, three of the housings 84–86 have a substantially kidney bean shaped cross section and the radially extending housing 87 has a substantially keyhole shaped cross section. However, as with the channels 65, 75, the housings 84–87 could have any shape. Additionally, each mixing cylinder 89 is an open ended tube with a round cross section. However, any shaped cross section could be used.

Figure 16A:
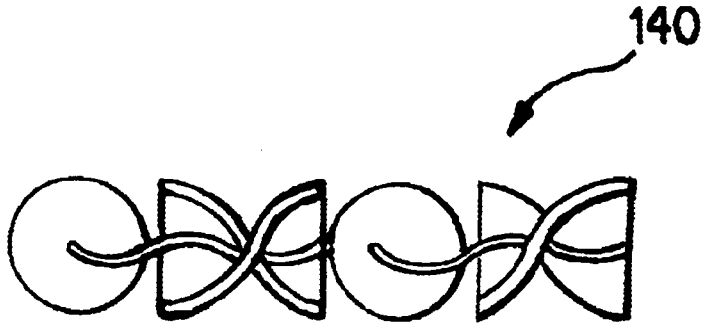
FIG. 16A illustrates a mixing element according to the present invention.

As shown in FIGS. 12 and 13, passive mixing elements 140 are positioned within the mixing cylinders 89. While it is contemplated that all of the mixing cylinders 89 include these mixing elements 140, it is also possible that fewer than all, possibly only one, of the mixing cylinders 89 include the mixing elements 140. For example, mixing cylinder 93 may not include a mixing element 140. The mixing elements 140 may be formed in various arrays and of any rigid or substantially rigid material. In preferred embodiments, the elongated mixing elements 140 (FIG. 16A) are formed of plastic or metal having sufficient rigidity to resist displacement and deflection by the material passing through the mixing cylinder. An example of the mixing elements 140 that can be used includes those sold under the trademark "STATIC MIXER" by Kenics Corporation, and described in U.S. Pat. No. 3,286,992, which is hereby incorporated by reference. In an alternative embodiment, the mixing elements 140 may include mixing blades 141 molded into the walls of the mixing cylinders 89. The actual structure and shape of the blades 141 and the mixing elements 140 will depend upon the viscosity of the components being mixed, since it is necessary to reduce obstructions in the mixing cylinders to a degree that will permit the mixed compounds to be dispensed at a desired rate without the development of excessive back pressure in the cartridge 1.

In use, the cartridge 1 is loaded into a conventional caulking gun, and the piercing rod 120 is advanced toward the rear end 5 of the body 2. As the piercing rod 120 is advanced, the head 124 of the piercing rod 120 moves from its rest position, where the head 124 is retracted into the mixing cylinder 90, through the seals 26, 27 and into the interior of the cylinder 15. The piercing rod 120 is pushed into the tube so that the flat section 123, is parallel to the top of the nozzle 6, this will ensure that barriers 26 and 27 are punctured and no longer prevent components A and B from contacting each other. After the head 124 has been located within the cylinder 15, the nozzle 8 is screwed into the discharge opening 6.

When pressure is applied to the plunger 10 by the gun, the first component A from the inner, collapsible container 12 is advanced into the well 42 past the ruptured seal 26, whilst the second component B in the reservoir 13 is forced through the channels 45 and into the well 42 where it meets with the first component A. The components A, B then pass through the openings 44, 62 and into the centrally located mixing cylinder 90.

The below discussed steps are best illustrated in FIGS. 11B–11D. Upon entering the mixing cylinder 90, the components A, B contact the plate 91 and are directed across a portion of the rear end 82 by the plate 91, the sidewalls of the channel 88 and the channel 65 to the first, circumferentially positioned mixing cylinder 93 of the radially extending mixing housing 87. The components A, B pass through the mixing elements 140 along the length of the mixing cylinder 93 as they are forced toward the front end 83 of the mixing body 80.

At the front end 83 of the mixing body 80, the mixing cylinder 93 opens to a channel 88 and the cover channel 75. As discussed above, each channel 88 extends around one of the mixing cylinders 89 of two adjacent mixing housings 84–87. As a result, when the mixed components A, B are forced out of the mixing cylinder 93, they travel into and across the channel 88 extending along the front end 83 and into a mixing cylinder 94 of the adjacent mixing housing 84. The mixed components A, B are then forced through the mixing cylinder 94 where they pass the mixing elements 140 as the mixed components continue along the mixing path and return to the rear end 82 of the mixing body 80. After reaching the rear end 82 of the mixing cylinder 94, the mixed components A, B are forced along the channel 88 at the rear end 82 and into mixing cylinder 95 of the same mixing housing 84. As illustrated in FIG. 12, the mixing cylinder 95 is circumferentially spaced from mixing cylinder 94 while still forming part of the mixing housing 84.

After entering the mixing cylinder 95, the mixed components A, B are again forced toward the front end 83 of the mixing body 80. If mixing elements 140 are positioned within the mixing cylinder 95, the components are further mixed as they pass through the mixing cylinder 95. Upon reaching the front end 83, the mixed components A, B travel within another channel 88 and into the mixing channel 96 of the next mixing housing 85. The mixed components A, B are then forced through the mixing channel 96 toward the rear end 82 and past any contained mixing elements 140. Similar to that previously described, the mixed components A, B then travel across a portion of the rear end 82 within another channel 88 of the mixing housing 80 in the direction of the next circumferentially positioned mixing channel 97 of mixing housing 85. Upon reaching the mixing channel 97, the mixed components A, B enter the mixing channel 97 and are forced past any contained mixing elements 140 in the direction of the front 83 of the mixing housing 80.

The method of forcing the mixed components A, B along the mixing path through the mixing cylinders 90 and 93–99 and along the channels 88 continues until the mixed components A, B are forced through the mixing cylinder 99 and past any mixing elements 140 contained there within. After exiting the mixing cylinder 99 at the front end 83 of the mixing body 80, the mixed components enter the channel 88A bounded by the mixing body and the end plate 71, The forced components A, B travel through the channel 88A to an opening 105 that opens into the front of the central mixing channel 90 and out the discharge opening 6 and into the discharge nozzle 8 for application.

As can be understood from the above descriptions, the front end 83 of the mixing cylinder 99 is at the terminal end of the mixing path, whereas the rear end 82 of mixing element 93 is at the beginning end of the mixing path. Also can be seen from the figures, the front end 83 of the mixing element 93 is counter clockwise to the rear end 82 of the mixing element 93 when the mixing path extends in a clockwise pattern. The converse is also true if the mixing path extends in a counter-clockwise pattern. The mixing cylinders 89 are spaced from each other around the circumference of the mixing body by a predetermined distance, such as 360° or the length of the circumference divided by N, where N is the number of circumferentially spaced mixing cylinders 93–99, not including the centrally spaced mixing cylinder 90. Other known ways of spacing the cylinders can also be used.

According to the above described embodiments, it maybe necessary to use the entire contents of the cartridge at one time, or to discard the remainder, at least in the case of components that harden after mixing, since the mixed components in the mixing unit 60 will set if allowed to remain therein, thus ruining the mixing and blocking access to the remainder of the discharge nozzle 8.

Figure 15:
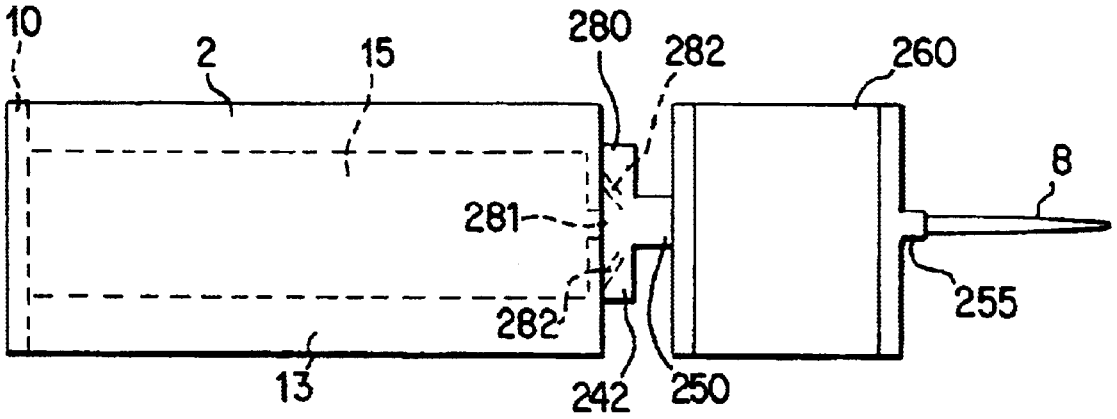
FIG. 15 illustrates an alternative embodiment of the present invention with a removably attached mixing unit.

FIG. 15 shows an alternative embodiment that permits the contents of the cartridge 1 to be used over an extended period. This embodiment is generally similar to that of FIG. 1, except that the mixing unit 260 is a separate external unit that is removably secured to the body 2. For example, in a preferred embodiment, the mixing unit 260 can have a coupling 250 that threadably or frictionally fits it onto a well 242 that is removably secured on the end of the body 2. The mixing unit 260 also has a coupling 255 for the nozzle 8. In this embodiment, the well 242 is connected to the mixing unit 260 and includes a neck 280 that has concentric passageways 281, 282 that deliver the components to the well 242. The seal 26 (FIG. 3) covers the openings of the passageways 281, 282. A removable screw cap (not shown) can be used to cover seal 26 before the mixing unit 260 is secured to the coupling 250.

The concentric passageways 281, 282 for the two components provide for the saving of any unused portions of the contents of the cartridge by removing the well 242 and the mixing unit 260 and replacing the cap over the punctured seal 26. In this embodiment, a cleaned or new well 242 and mixing unit 260 are attached to the coupling 250 before the cartridge 1 is used again.

Alternative embodiments of connecting the body 2 and the well 42 to the mixing unit 60 can also be used. For example, these alternative embodiments could include those embodiments disclosed in U.S. Pat. No. 4,676,657, which has been incorporated by reference.

In some applications, particularly using large, fully enclosed caulking guns, it is preferred to use cartridges, or "sausages" in which the conventional rigid body is replaced by a flexible tubular bag containing the material to be dispensed, the remaining functions of the body being provided by the gun itself. The present invention can be adapted for such a use as described in U.S. Pat. No. 4,676,657. In this embodiment, a flexible cylindrical tube, of similar construction to cylinder 15, previously described, replaces the body 2. In order to maintain proper proportioning of the components, it will usually be desirable to support the outer bag by a light spring in the same manner as the cylinder 15 is supported. The remainder of the cartridge is substantially the same as described above with respect to the cartridge in FIG. 1.

Figure 16B:
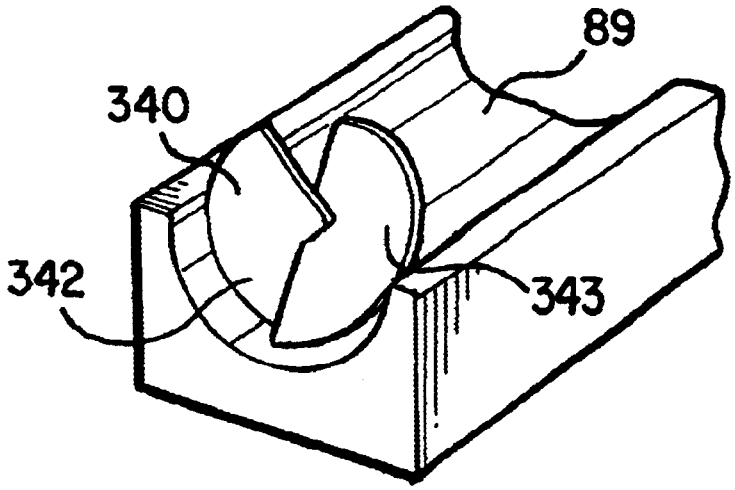
FIG. 16B illustrates an alternative embodiment of a passive mixing element that may be utilized in the various embodiments of mixing unit.

FIG. 16B illustrates an alternative form of the passive mixing element 340. Each element 340 is formed by a disc of metal or synthetic plastic, which has been slit from diametrically opposed points on its periphery to spaced points close to its center, so that opposite halves 342, 343 of the disc may be twisted relative to one another to produce mixing elements as shown in the Figure. Similar elements may be molded integrally with a mixing element 340 rather than being formed separately.

While the above described embodiments each contemplate the dispensing of a product made up of two components stored concentrically, it will be appreciated that the principles of the invention may be utilized with products made up of more than two components, and these need not necessarily be stored coaxially, provided that provision can be made for breaking any necessary seals before use of the cartridge. It will also be understood that the words used are descriptive rather than limiting, and that various changes may be made without departing from the spirit or scope of the invention as claimed below.

We claim:

1. A cartridge assembly for mixing components of a material, said cartridge assembly comprising a component carrying body having a longitudinal axis extending between a front end and a rear end, a discharge nozzle proximate said front end and a mixing unit for mixing the components and delivering the mixed components to the discharge nozzle, said mixing unit including a plurality of mixing cylinders that each have a longitudinal axis that extends substantially parallel to said longitudinal axis of the component carrying body.

2. The cartridge assembly of claim 1 wherein said component carrying body includes a first reservoir for holding a first of the components and a second reservoir for holding a second of the components, wherein said reservoirs are isolated from each other within the carrying body.

3. The cartridge assembly of claim 2 further comprising a flow directing member having a first component opening for receiving the first component from the first reservoir and at least one second component opening for receiving the second component from the second reservoir.

4. The cartridge assembly of claim 3 wherein said flow directing member includes a well for receiving the components from said first and second openings and a discharge opening through which the received components can be delivered to the mixing unit.

5. The cartridge assembly of claim 1 wherein said mixing unit is positioned within the component carrying body and has a substantially cylindrical shape with a substantially circular cross section.

6. The cartridge assembly of claim 1 wherein said mixing unit includes a front inner surface, a rear inner surface, a mixing body extending between said inner surfaces and mixing elements within said mixing body.

7. The cartridge assembly of claim 6 wherein a rear end of said mixing unit includes a removable plate carrying said rear inner surface, a front end of said mixing unit includes a removable plate carrying said front inner surface and said plates each include a centrally located opening for receiving and discharging the components, respectively.

8. The cartridge assembly of claim 6 wherein said rear inner surface includes a plurality of flow guiding channels that extend away from said rear inner surface toward said mixing body, each said flow guiding channel being spaced from an adjacent one of the flow guiding channels along said inner surface.

9. The cartridge assembly of claim 8 wherein at least two of said guiding channels are coextensive with a portion of a circumference of said inner surface.

10. The cartridge assembly of claim 8 wherein said mixing unit includes an inlet opening that extends through a center of said rear inner surface, and one of said guiding channels extends radially away from said inlet opening.

11. The cartridge assembly of claim 8 wherein said mixing unit includes a discharge opening that extends through a center of said front inner surface, and one of said guiding channels extends radially away from said inlet opening.

12. The cartridge assembly of claim 6 wherein said front inner surface includes a plurality of flow guiding channels that extend away from said front inner surface toward said mixing body, each said flow guiding channel being spaced from an adjacent one of the flow guiding channels along said inner surface.

13. The cartridge assembly of claim 12 wherein at least two of said guiding channels is coextensive with a portion of a circumference of said inner surface.

14. The cartridge assembly of claim 6 wherein said mixing cylinders extend within said mixing body, and wherein said mixing cylinders and flow guiding channels on said inner surfaces define a mixing path.

15. The cartridge assembly of claim 14 wherein one of said mixing cylinders is centrally located within said mixing body and communicates with an inlet opening at the rear of said mixing body and a discharge opening at the front of said mixing body.

16. The cartridge assembly of claim 15 wherein a plate having a central aperture for receiving a stem of a piercing member is positioned within said centrally located mixing body proximate the rear end of the mixing body.

17. The cartridge assembly of claim 16 wherein said mixing cylinders include a plurality of circumferentially positioned mixing cylinders that are spaced from each other along a circumference of the mixing unit, and wherein one of said flow guiding channels on said rear inner surface extends radially from the centrally located mixing cylinder to a first of the circumferentially positioned mixing cylinders in the mixing path.

18. The cartridge assembly of claim 17 wherein one of said flow guiding channels on said front inner surface extends radially between a last of the circumferentially positioned mixing cylinders in the mixing path and the centrally located mixing cylinder.

19. The cartridge assembly of claim 18 wherein said first of the circumferentially positioned mixing cylinders in the mixing path is isolated from the last of the circumferentially positioned mixing cylinders in the mixing path in a direction opposite that of the mixing path.

20. A cartridge assembly for mixing components of a material, said cartridge assembly comprising a component carrying body having a front end and a rear end, a discharge nozzle proximate said front end and a mixing unit for mixing the components and delivering the mixed components to the discharge nozzle, said mixing unit comprising a plurality of spaced cylindrical mixing chambers and at least one mixing element positioned in at least one of the mixing chambers.

21. The cartridge assembly of claim 20 wherein said cylindrical mixing chambers define at least a portion of a mixing path that alternates its direction between the front end and a rear end of the mixing unit.

22. The cartridge assembly of claim 21 wherein said mixing path also extends around a circumference of the mixing unit.

23. The cartridge assembly of claim 21 wherein at least one of the cylindrical mixing chambers is in fluid communication with an adjacent upstream one of the cylindrical mixing chambers at a first end and an adjacent downstream one of the cylindrical mixing cylinders at a second end opposite said first end.

24. The cartridge assembly of claim 20 wherein the cylindrical mixing chambers each have a longitudinal axis that is substantially parallel to a longitudinal axis of the component carrying body.

25. The cartridge assembly of claim 20 wherein said component carrying body includes a first reservoir for holding a first of the components and a second reservoir for holding a second of the components, wherein said reservoirs are separated from each other within the carrying body.

26. The cartridge assembly of claim 25 further comprising a flow directing member having a first component opening for receiving the first component from the first reservoir and at least one second component opening for receiving the second component from the second reservoir.

27. The cartridge assembly of claim 20 wherein a front end of a first of the cylindrical mixing chambers is isolated from a front end of one of the cylindrical mixing chambers that is immediately upstream of said first cylindrical mixing chamber along a front end of the mixing unit, a rear end of the first cylindrical mixing chamber is open to a rear end of the immediately upstream cylindrical mixing chamber along a rear end of the mixing unit and a rear end of the first cylindrical mixing chamber is isolated from a rear end of another of the cylindrical mixing chambers that is immediately downstream of said first cylindrical mixing chamber along a rear end of the mixing unit.

28. The cartridge assembly of claim 20 wherein said mixing unit includes a front inner surface, a rear inner surface and a mixing body extending between said inner surfaces.

29. The cartridge assembly of claim 28 wherein said rear inner surface includes a plurality of flow guiding channels that extend away from said rear inner surface toward said mixing body, each said flow guiding channel being spaced from an adjacent one of the flow guiding channels along said rear inner surface.

30. The cartridge assembly of claim 29 wherein said front inner surface includes a plurality of flow guiding channels that extend away from said front inner surface toward said mixing body, each said flow guiding channel being spaced from an adjacent one of the flow guiding channels along said front inner surface.

31. The cartridge assembly of claim 29 wherein said cylindrical mixing chambers extend within said mixing body, and wherein said cylindrical mixing chambers and flow guiding channels on said inner surfaces define a mixing path.

32. The cartridge assembly of claim 31 wherein one of said cylindrical mixing chambers is centrally located within said mixing body and communicates with an inlet opening at the rear of said mixing body and a discharge opening at the front of said mixing body.

33. The cartridge assembly of claim 32 wherein said cylindrical mixing chambers further include a plurality of circumferentially positioned cylindrical mixing chambers that are spaced from each other along a circumference of the mixing unit, and wherein one of said flow guiding channels on said rear inner surface extends radially from the centrally located cylindrical mixing chamber to a first of the circumferentially positioned cylindrical mixing chambers in the mixing path.

34. The cartridge assembly of claim 33 wherein one of said flow guiding channels on said front inner surface extends radially between a last of the circumferentially positioned cylindrical mixing chambers in the mixing path and the centrally located cylindrical mixing chamber.

35. A cartridge assembly for mixing components of a material, said cartridge assembly comprising a component carrying body having a front end and a rear end and a mixing unit for mixing the components and delivering the mixed components to a discharge nozzle, said mixing unit comprising a mixing body including a mixing path that extends between a front end and a rear end of the mixing body, said mixing path having a first mixing region that is offset from a terminal mixing region in a direction that is opposite the direction of the mixing path.

36. The cartridge assembly of claim 35 wherein said mixing regions each include a mixing cylinder.

37. The cartridge assembly of claim 36 wherein said mixing path is at least partially defined by a plurality of said mixing cylinders and a plurality of guiding channels, each guiding channel extending between ends of adjacent mixing cylinders.

38. The cartridge assembly of claim 37 wherein a rear end of a first of the mixing cylinders is connected to a rear end of one of the mixing cylinders that is immediately upstream of said first mixing cylinder along said mixing path by one of the guiding channels, and a front end of the first mixing cylinder is connected to a front end of another of the mixing cylinders that is immediately downstream of said first mixing cylinder along said mixing path.

39. The cartridge assembly of claim 38 wherein the front end of the first of the mixing cylinders is isolated from a front end of the mixing cylinder that is immediately upstream of said first mixing cylinder along a front end of the mixing unit, and a rear end of the first mixing cylinder is isolated from a rear end of the another of the mixing cylinders that is immediately downstream of said first mixing cylinder along a rear end of the mixing unit.

40. The cartridge assembly of claim 37 wherein said mixing unit includes mixing housings, each mixing housing including a pair of the mixing cylinders, and wherein at one end of the mixing unit one of said guiding channels connects adjacent mixing cylinders of the same mixing housings, and at an opposite end of the mixing unit one of said guiding channels connects adjacent mixing channels of separate housings.

41. The cartridge assembly of claim 40 further comprising a plurality of mixing elements positioned within said mixing cylinders.

42. The cartridge assembly of claim 40 wherein one of said mixing cylinders is centrally located within said mixing body and communicates with an inlet opening at the rear end of said mixing body and a discharge opening at the front of said mixing body.

43. The cartridge assembly of claim 42 wherein said mixing cylinders further include a plurality of circumferentially positioned mixing cylinders that are spaced from each other along a circumference of the mixing unit, and wherein one of said flow guiding channels extends radially from the centrally located mixing cylinder to a first of the circumferentially positioned mixing cylinders in the mixing path.

44. The cartridge assembly of claim 43 wherein one of said flow guiding channels extends radially between a last of the circumferentially positioned mixing cylinders in the mixing path and the centrally located mixing cylinder.

45. The cartridge assembly of claim 44 wherein said first of the circumferentially positioned mixing cylinders in the mixing path is isolated from the last of the circumferentially positioned mixing cylinders in the mixing path in a direction opposite that of the flow path.

46. A cartridge assembly for use with a caulking gun to mix and dispense components of a material, said cartridge assembly comprising a component carrying body having a front end and a rear end and a mixing unit for mixing the components and delivering the mixed components to a discharge nozzle, said mixing unit comprising a mixing body including a mixing path that extends between a rear end and a front end of the mixing body for moving the components in a first direction from the rear end of the mixing body to the front end of the mixing body and then in an opposite direction toward the rear end of the mixing body.

47. The cartridge assembly of claim 46 wherein said mixing path includes a first mixing cylinder that is coextensive with and spaced from a terminal mixing cylinder.

48. The cartridge assembly of claim 47 wherein said first and terminal mixing cylinders are adjacent each other along a circumference of the mixing body.

49. The cartridge assembly of claim 48 wherein a plurality of mixing cylinders and a plurality of component guiding channels extend between said first and terminal mixing cylinders along said mixing path.

50. The cartridge of claim 49 wherein a plurality of said mixing cylinders includes a plurality of mixing elements.

51. The cartridge assembly of claim 49 wherein one of said mixing cylinders is centrally positioned within said mixing body, and wherein a first end of said centrally positioned mixing cylinder is in communication with an inlet opening in said mixing unit and said first mixing chamber at one end of said mixing path, and a second end of said centrally positioned mixing cylinder is in communication with a discharge opening in said mixing unit and the terminal mixing cylinder at a second end of said mixing path.

52. The cartridge assembly of claim 49 wherein a rear end of a first of the mixing cylinders is connected to a rear end of one of the mixing cylinders that is immediately upstream of said first mixing cylinder along said mixing path by a guiding channel, and a front end of the first mixing cylinder is connected to a front end of another of the mixing cylinders that is immediately downstream of said first mixing cylinder along said mixing path.

53. The cartridge assembly of claim 52 wherein the front end of the first of the mixing cylinders is isolated from a front end of the mixing cylinder that is immediately upstream of said first mixing cylinder along a front end of the mixing unit, and a rear end of the first mixing cylinder is isolated from a rear end of the another of the mixing cylinders that is immediately downstream of said first mixing cylinder along a rear end of the mixing unit.

54. A cartridge assembly for mixing and dispensing components of a material, said cartridge assembly comprising a component carrying body having a front end and a rear end, and a mixing unit for mixing the components and delivering the mixed components to a discharge nozzle, said mixing unit comprising a mixing body including a substantially sinusoidal shaped mixing path.

55. The cartridge assembly of claim 54 wherein said sinusoidal mixing path within the mixing body begins at rear end of a mixing cylinder and terminates at a front end of said mixing cylinder.

56. The cartridge assembly of claim 54 wherein said sinusoidal mixing path is at least partially defined by a plurality of mixing cylinders that extend between front and rear ends of the mixing unit and a plurality of guiding channels that each extend between adjacent mixing cylinders.

57. The cartridge assembly of claim 56 wherein one of said mixing cylinders is connected at a first end to an upstream one of said mixing cylinders by a first one of said guiding channels and at a second end to a downstream one of the mixing cylinders by a second one of said guiding channels.

58. The cartridge assembly of claim 57 wherein said mixing cylinders extend between a front end and a rear end of the mixing unit and have longitudinal axes that extend parallel to a longitudinal axis of the component carrying body.

59. The cartridge assembly of claim 54 further including a discharge nozzle attached to the component carrying body for dispensing the mixed components, and a plurality of mixing elements positioned along said mixing path.

60. The cartridge assembly of claim 54 wherein said mixing unit includes a plurality of mixing housings each including a plurality of mixing cylinders; and wherein at a first end of the mixing unit first and second mixing cylinders of a first of the mixing housings are in communication with each other, and at the opposite end of the mixing unit said first mixing cylinder is in communication with a mixing cylinder of a second mixing housing and said second mixing cylinder is in communication with a mixing cylinder of a third mixing housing.

* * * * *

UNITED STATES PATENT AND TRADEMARK OFFICE

CERTIFICATE OF CORRECTION

PATENT NO. : 6,705,756 B2
DATED : March 16, 2004
INVENTOR(S) : Alex Botrie et al.

It is certified that error appears in the above-identified patent and that said Letters Patent is hereby corrected as shown below:

Column 14,
Line 44, please replace “claim 40” with -- claim 37 --
Line 47, please replace “claim 42” with -- claim 37 --

Signed and Sealed this

Fifth Day of April 2005

JON W. DUDAS
*Director of the United States Patent and Trademark Office*